US009480896B2

(12) United States Patent
Chen

(10) Patent No.: US 9,480,896 B2
(45) Date of Patent: Nov. 1, 2016

(54) TRAMPOLINE BASKETBALL COURT

(71) Applicant: Samuel Chen, Shanghai (CN)

(72) Inventor: Samuel Chen, Shanghai (CN)

( * ) Notice: Subject to any disclaimer, the term of this patent is extended or adjusted under 35 U.S.C. 154(b) by 145 days.

(21) Appl. No.: 14/516,980

(22) Filed: Oct. 17, 2014

(65) Prior Publication Data

US 2016/0107055 A1 Apr. 21, 2016

(51) Int. Cl.

*A63B 67/00* (2006.01)
*A63B 5/11* (2006.01)
*A63B 63/00* (2006.01)

(52) U.S. Cl.

CPC ..... *A63B 67/002* (2013.01); *A63B 5/11* (2013.01); *A63B 63/00* (2013.01); *A63B 2067/005* (2013.01)

(58) Field of Classification Search

CPC ..... A63B 67/00; A63B 5/11
USPC ..... 473/472, 471, 473, 468, 469, 470; 482/27

See application file for complete search history.

(56) References Cited

U.S. PATENT DOCUMENTS

| | | | | |
|---|---|---|---|---|
| 3,201,126 | A * | 8/1965 | Nissen | A63B 5/11 182/139 |
| 5,624,122 | A * | 4/1997 | Winkelhorn | A63B 5/11 473/471 |
| 6,988,967 | B2 * | 1/2006 | Allison | A63B 5/11 473/469 |
| 8,435,142 | B2 * | 5/2013 | Gibson | A63B 41/02 273/402 |
| 8,764,575 | B1 * | 7/2014 | Gurley | 472/92 |
| 2010/0210422 | A1 * | 8/2010 | Crawford | A63B 5/11 482/27 |
| 2016/0107055 | A1 * | 4/2016 | Chen | A63B 67/002 473/472 |

* cited by examiner

*Primary Examiner* — Gene Kim
*Assistant Examiner* — M Chambers
(74) *Attorney, Agent, or Firm* — Clement Cheng

(57) ABSTRACT

A trampoline court has a trampoline frame providing a frame for multiple trampolines arranged in a regular pattern including a first player section, and a second player section. The first player section includes a first player middle trampoline bounded by a pair of first player side trampolines. A first player right trampoline extends to the right of the first player middle trampoline and a first player trampoline extends to the left of the first player middle trampoline. The first player middle trampoline is generally horizontal. The first player side trampolines are angled toward each other relative to the first player middle trampoline.

11 Claims, 3 Drawing Sheets

TRAMPOLINE BASKETBALL COURT

FIELD OF THE INVENTION

The present invention is in the field of trampoline basketball courts especially trampoline basketball courts.

DISCUSSION OF RELATED ART

Trampolines generally a trampoline bed stretched across the trampoline frame and biased by trampoline springs connecting between the trampoline bed and the trampoline frame. The tension of the springs allows rebounding. The trampoline frame may further include a trampoline enclosure that encircles the trampoline bed. A trampoline pad can cover the springs for increased safety.

Trampolines can be combined with basketball or other goals to make a game. Trampolines have been a popular method for children to stay active since they were first introduced into the market. Trampolines are typically used to enhance the ability to jump. Some varieties of trampolines have been invented to complement this enhanced ability. The enhanced ability to jump is a skill that can be perfectly applied to basketball and the popular desire to score a slam dunk. A variety of different trampoline basketball courts have been discussed in patents and printed publications.

An invention that involves the use of a trampoline to enhance the ability to reach a goal is U.S. Pat. No. 3,201,126 to George P. Nissen, entitled Game Apparatus with Target and Trampoline, having an issue date of Aug. 17, 1965, the disclosure of which is incorporated herein by reference. The construction of this invention involves a trampoline that can be modified for different games. One modification involves the trampoline with a center partition that includes an elongated tube and two goals or targets on opposite ends of the trampoline for a which a player must be suspended in mid-air to throw an object, such as a ball, thru the partition and into the goal or target on the opposite side of the trampoline.

The partnering of the sport of basketball and trampolines can be seen in U.S. Pat. No. 5,833,557 to inventor Edward W. Cole entitled Trampoline Basketball Game, having an issue date of Nov. 10, 1998, the disclosure of which is incorporated herein by reference. Trampoline Basketball Game is a trampoline device with two basketball hoops or goals found at opposite ends of the device. The trampoline provides a flexible rebound surface from edge to edge. A central partition divides the trampoline into two areas. With one player in each area, the goal is to get the ball into the other player's basket or goal.

Another similar trampoline game is presented in U.S. Pat. No. 6,988,967 to Danny Brian Allison entitled Team Trampoline Game and Method of Playing the Same, issued Jan. 24, 2006, the disclosure of which is incorporated herein by reference. This invention presents a trampoline to be used for a team trampoline game. The device involves an elongated, rectangular trampoline with two goals that permit a game projectile, such as a ball, to pass through. The game is to be played while bouncing on the trampoline.

SUMMARY OF THE INVENTION

A trampoline court has a trampoline frame providing a frame for multiple trampolines arranged in a regular pattern including a first player section, and a second player section. The first player section includes a first player middle trampoline bounded by a pair of first player side trampolines. A first player right trampoline extends to the right of the first player middle trampoline and a first player trampoline extends to the left of the first player middle trampoline. The first player middle trampoline is generally horizontal. The first player side trampolines are angled toward each other relative to the first player middle trampoline.

The first player right trampoline and the first player left trampoline have an angle between 20° and 50° relative to the first player middle trampoline. The second player section includes a second player middle trampoline bounded by a pair of second player side trampolines. A second player right trampoline extends to the right of the second player middle trampoline and a second player trampoline extends to the left of the second player middle trampoline. The second player middle trampoline is generally horizontal and the second player side trampolines are angled toward each other relative to the second player middle trampoline.

The second player right trampoline and the second player left trampoline have an angle between 20° and 50° relative to the second player middle trampoline. A partition panel is mounted between the first player section and the second player section. A first player terminal enclosure panel encloses a terminal portion of the first player section. A first player goal is mounted to the trampoline frame in the second player section. A second player terminal enclosure panel encloses a terminal portion of the second player section. A second player goal is mounted to the trampoline frame in the first player section. A first player right side goal is mounted to the right of the first player goal and a first player left side goal is mounted to the left of the first player goal. A second player right side goal is mounted to the right of the second player goal and a second player left side goal is mounted to the left of the second player goal.

The trampoline frame preferably has a plurality of trampoline legs supporting the trampoline frame. The trampoline frame has a first player terminal frame member extending across a terminal edge of the first player section. The first player terminal frame member has a pair of first player terminal frame member upper portions connected by a first player terminal frame member top tension connector. A partition frame member extends between the first player section and the second player section. The partition frame member has a pair of upper portions connected by a first player terminal frame member top tension connector. A second player terminal frame member extends across a terminal edge of the second player section. The second player terminal frame member has a pair of second player terminal frame member upper portions connected by a second player terminal frame member top tension connector.

The trampoline frame also has a first player right enclosure panel extending from a right side of the first player right trampoline. The first player right enclosure extends above the first player right trampoline. A first player left enclosure panel extends from a left side of the first player left trampoline. The first player left enclosure extends above the first player left trampoline. A second player right enclosure panel extending from a right side of the second player right trampoline. The second player right enclosure extends above the first player second trampoline.

A second player left enclosure panel extends from the left side of the second player left trampoline. The second player left enclosure extends above the second player left trampoline.

Preferably, the trampoline court first player right trampoline and the first player left trampoline have an angle between 25° and 35° relative to the first player middle trampoline. Preferably the second player right trampoline and the second player left trampoline have an angle between 25° and 35° relative to the second player middle trampoline.

Figure 1:
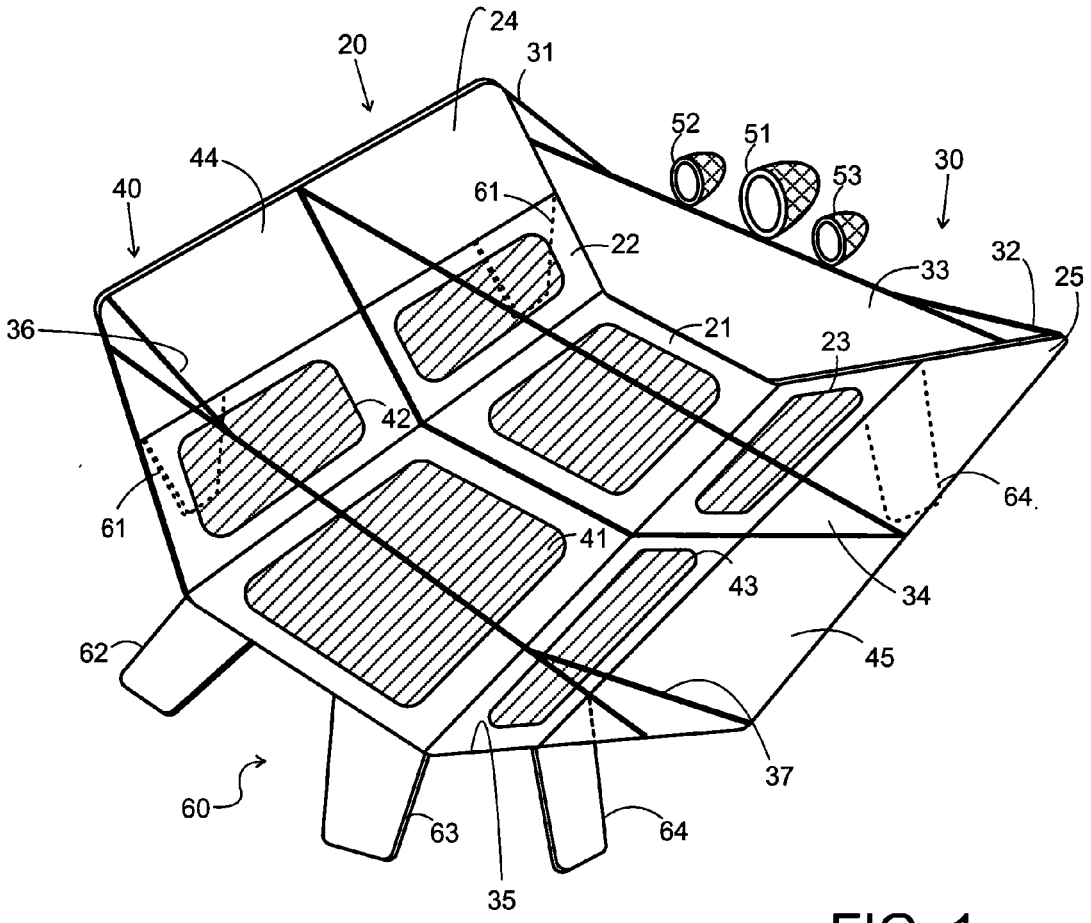
FIG. 1 is a perspective view of the present invention.
Figure 2:
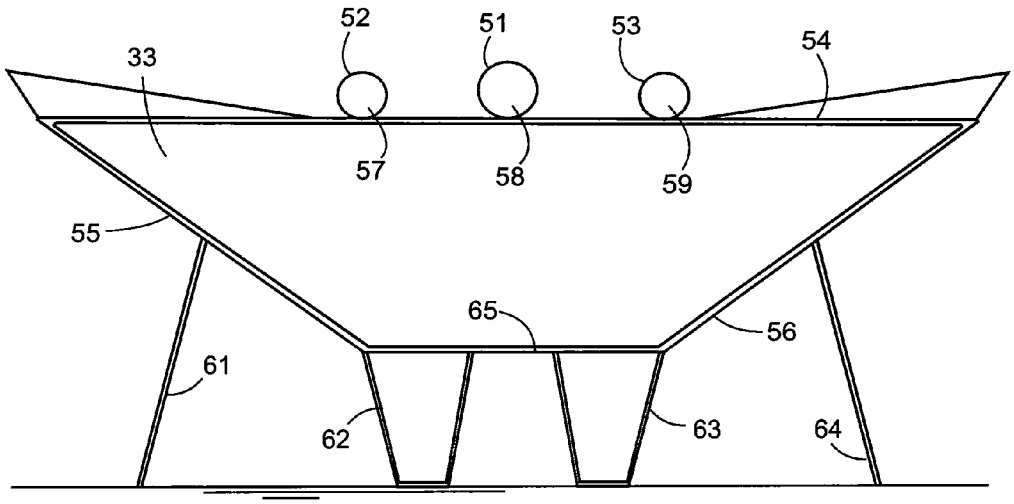
FIG. 2 is a front view diagram of the present invention.
Figure 3:
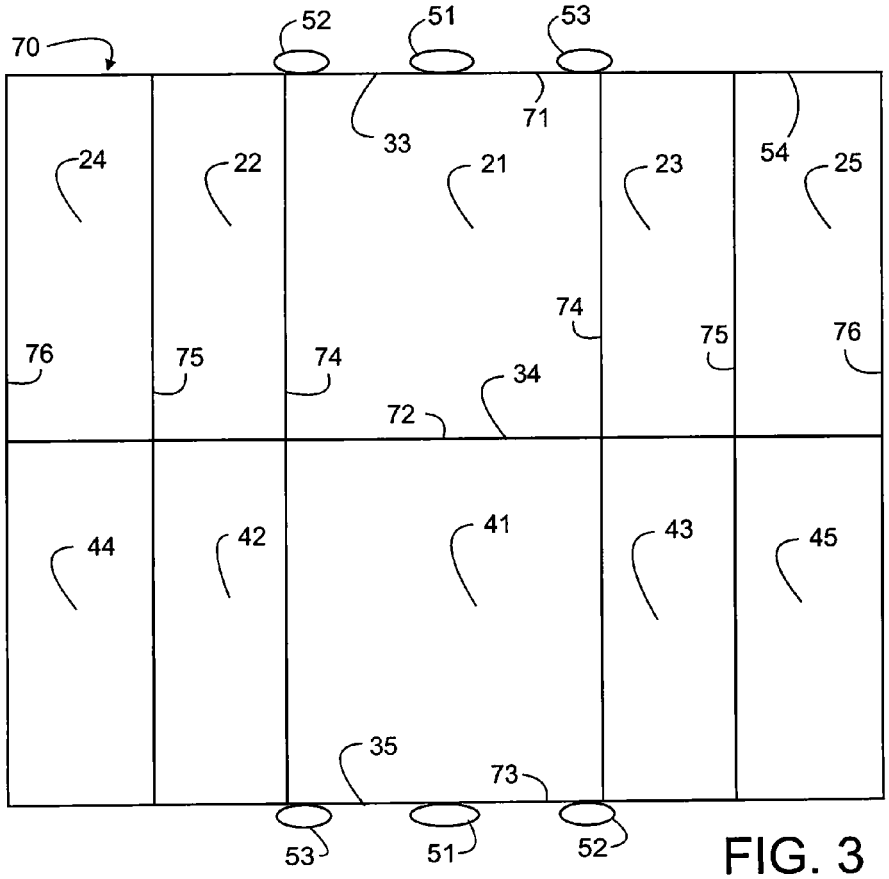
FIG. 3 is a top view diagram of the present invention.
Figure 4:
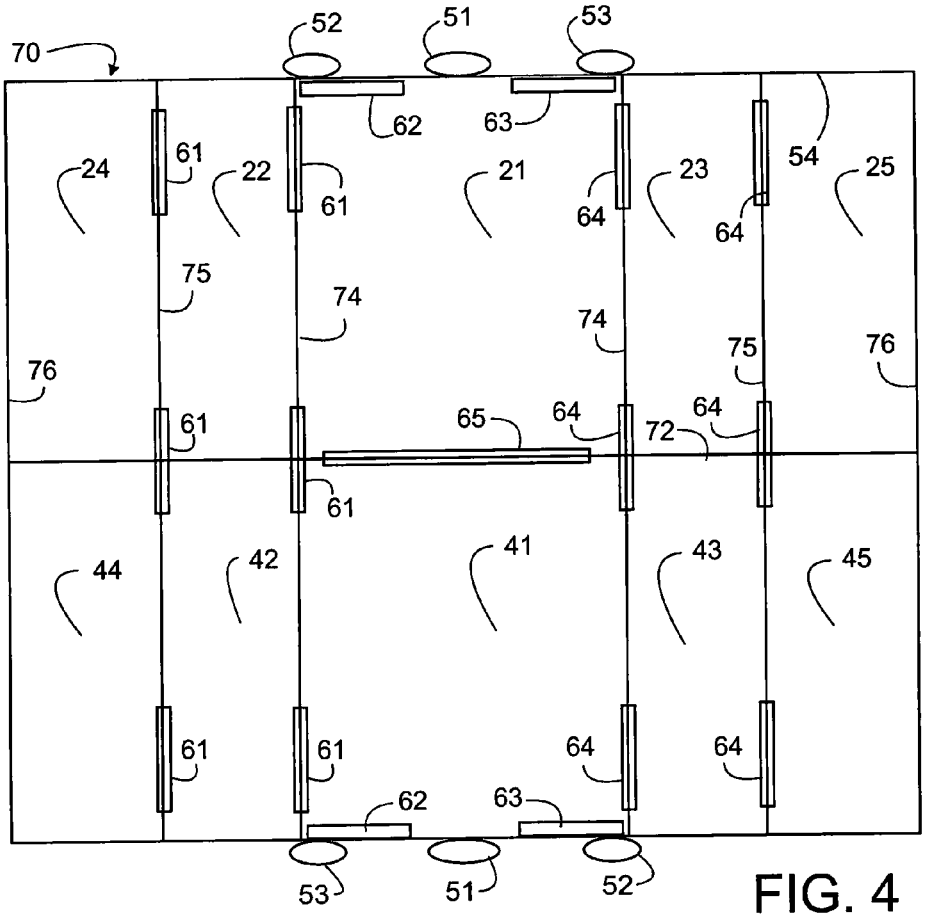
FIG. 4 is a top view diagram of the present invention showing placement of trampoline leg footing beneath the trampoline bed.

The following call out list of elements can be a useful guide in referencing the elements of the drawings.

20 First Player Section
21 First Player Middle Trampoline
22 First Player Right Trampoline
23 First Player Left Trampoline
24 First Player Right Enclosure Panel
25 First Player Left Enclosure Panel
30 Enclosure Frame
31 First Player Terminal Enclosure Panel Right Support
32 First Player Terminal Enclosure Panel Left Support
33 First Player Terminal Enclosure Panel
34 Partition Panel
35 Second Player Terminal Enclosure Panel
36 Second Player Terminal Enclosure Panel Right Support
37 Second Player Terminal Enclosure Panel Left Support
40 Second Player Section
41 Second Player Middle Trampoline
42 Second Player Left Trampoline
43 Second Player Right Trampoline
44 Second Player Left Enclosure Panel
45 Second Player Right Enclosure Panel
51 Middle Goal
52 Right Side Goal
53 Left Side Goal
54 Top Tension Connector
55 Enclosure Support
56 Side Trampoline Support
57 Right Side Goal Hoop
58 Middle Goal Hoop
59 Left Side Goal Hoop
60 Trampoline Frame
61 First Distal Trampoline Leg
64 Second Distal Trampoline Leg
62 First Terminal Trampoline Leg
63 Second Terminal Trampoline Leg
65 Middle Trampoline Support Leg
71 First Player Terminal Frame Member
72 Partition Frame Member
73 Second Player Terminal Frame Member
74 Middle Trampoline Frame Member
75 Side Trampoline Frame Member
76 Enclosure Frame Member

DETAILED DESCRIPTION OF THE PREFERRED EMBODIMENT

The present invention is a trampoline basketball court made for two players. A first player section 20 opposes a second player section 40. A partition panel 34 separates the first player section 20 from the second player section 40. The first player has a first player middle trampoline 21 bounded by a first player right trampoline 22 to the right of the first player middle trampoline 21. The first player also has a first player middle trampoline 21 bounded by a first player left trampoline 23. The new first player right enclosure panel 24 extends from the first player right trampoline 22. The first player left enclosure panel 25 extends from the first player left trampoline 23. The first player right trampoline 22 can be parallel to the first player right enclosure panel 24. The first player left enclosure panel 25 can be parallel to the first player left trampoline 23. The first player middle trampoline 21 is horizontal and receives the first player right trampoline 22 and the first player left trampoline 23 at an angle of approximately 20° to 50°, and is preferably at about a 30° or 45° angle.

A second player section 40 has a second player middle trampoline 41. The second player middle trampoline 41 is bounded between a second player left trampoline 42 and a second player right trampoline 43. The second player left trampoline 42 extends to a second player left enclosure panel 44. The second player right trampoline 43 extends to a second player right enclosure panel 45. The second player left enclosure panel 44 and the second player right enclosure panel 45 can be parallel to the second player left trampoline 42 and the second player right trampoline 43. The second player middle trampoline 41 is horizontal and receives the second player right trampoline 43 and the second player left trampoline 42 at an angle of approximately 20° to 50°, and is preferably at about a 30° or 45° angle.

A user can jump on the middle trampoline, the left trampoline or the right trampoline. The user can jump from the left to the right trampoline over the middle trampoline. Preferably, the middle trampoline is approximately 8' wide and the left and right trampoline is preferably 5' wide.

The enclosure frame 30 surrounds the trampoline area. The trampoline area can have a total of six trampolines. The enclosure frame 30 has a trapezoidal terminal enclosure panel on each side of the enclosure frame 30. The trapezoidal terminal enclosure panel can be reinforced by supports made of cable for example. A first player terminal enclosure panel right support 31 can support an upper right end of the first player terminal enclosure panel 33 and a first player terminal enclosure panel left support 32 can support an upper left end of the first player terminal enclosure panel 33. Similarly, second player terminal enclosure panel right support 36 can support an upper right end of a second player terminal enclosure panel 35 and a second player terminal enclosure panel left support 37 can support an upper left end of a second player terminal enclosure panel 35.

The pair of terminal enclosure panels includes the first player terminal enclosure panel 33 and the second player terminal enclosure panel 35. The pair of terminal enclosure panels can be made of netting or trampoline material. The pair of terminal enclosure panels are preferably trapezoidal shaped and partitioned by a partition panel 34 mounted between the pair of terminal enclosure panels. Goals can be mounted above the pair of terminal enclosure panels. The goals can be configured to receive a ball such as a basketball or football of various size. The middle goal 51 can be made larger than the right side goal 52 or the left side goal 53. The goals can be mounted on a top tension connector 54 that defines a top edge of the respective terminal enclosure panel. Each goal can have a net for momentarily retaining a ball. The middle goal 51 has a middle goal hoop 58. The right side goal 52 has a right side goal hoop 57. The left side goal hoop 59 has a left side goal 53. The enclosure frame 30 has an enclosure support 55 at the enclosure area, and has a side trampoline support 56 at a side trampoline area.

The trampoline frame 60 has a trampoline area that is supported by a first distal trampoline leg 61 and a second distal trampoline leg 64. On each left and right side of the trampoline, a pair of distal trampoline legs supports the horizontal trampoline area. Additionally, a first terminal trampoline leg 62, second terminal trampoline leg 63 support the trampoline frame 60 at a terminal portion below the first player terminal enclosure panel 33 and the second player terminal enclosure panel 35. The panels are preferably made of a sheet material such as metal mesh, woven polyethylene netting, or trampoline bed material.

The trampoline frame 60 can be built of hollow steel tubular zinc metallized members. The trampoline frame 60 can have a jointed assembly using assembly joints commonly used for trampoline frames. A first player terminal frame member 71 and a partition frame member 72 bounds the first player section 20. Similarly, the second player terminal frame member 73 and the partition frame member 72 the second player section 40. The first player terminal frame member 71, the second terminal frame member 73 and the partition frame member 72 all have a horizontal portion that is angled to continue at an angled portion. The first player terminal frame member 71, the second terminal frame member 73 and the partition frame member 72 all have a pair of upper ends connected together by a top tension connector.

The middle trampoline frame member 74 is generally horizontally disposed and defines a left and right edge of the middle trampoline. The side trampoline frame member 75 defines an upper edge of the side trampolines. The enclosure frame member 76 defines an upper edge of the enclosure frame 30. The trampoline frame 60 is constructed as a grid with multiple trampoline sections.

Preferably, there are several first distal trampoline legs 61 and several second distal trampoline legs 64. The first distal trampoline legs 61 and the second distal trampoline legs 64 can be connected to the side trampoline frame members 75. A middle trampoline support leg 65 can be connected to and support the partition frame member 72.

Appropriate safety equipment such as pads, spring cover pads can be implemented as needed.

Game play allows a user to jump from the middle trampoline to the left trampoline or the right trampoline and alternate between the three trampolines while attempting to score a basket against his opponent. The basket goals can be made of different sizes and can be oriented in a variety of different directions depending upon the game desired. The gameplay can also involve tag which may require a user to tag the other player with a game ball similar to a game of dodgeball. The gameplay can also add a beam emitter system for hitting targets connected to the trampoline frame in opposing player territory.

The following claims define the scope of the claimed invention.

The invention claimed is:

1. A trampoline court comprising:

a. a trampoline frame providing a frame for multiple trampolines arranged in a regular pattern;

b. a first player section, wherein the first player section includes a first player middle trampoline bounded by a pair of first player side trampolines, namely a first player right trampoline to the right of the first player middle trampoline and a first player trampoline to the left of the first player middle trampoline, wherein the first player middle trampoline is generally horizontal and wherein the first player side trampolines are angled toward each other relative to the first player middle trampoline, wherein the first player right trampoline and the first player left trampoline have an angle between 20° and 50° relative to the first player middle trampoline;

c. a second player section, wherein the second player section includes a second player middle trampoline bounded by a pair of second player side trampolines, namely a second player right trampoline to the right of the second player middle trampoline and a second player trampoline to the left of the second player middle trampoline, wherein the second player middle trampoline is generally horizontal and wherein the second player side trampolines are angled toward each other relative to the second player middle trampoline, wherein the second player right trampoline and the second player left trampoline have an angle between 20° and 50° relative to the second player middle trampoline, wherein the first player middle trampoline is adjacent to the second player middle trampoline, wherein the first player right trampoline is adjacent to the second player right trampoline and wherein the first player left trampoline is adjacent to the second player left trampoline;

d. a partition panel mounted between the first player section and the second player section;

e. a first player terminal enclosure panel enclosing a terminal portion of the first player section;

f. a first player goal mounted to the trampoline frame in the second player section adjacent to the second player middle trampoline;

g. a second player terminal enclosure panel enclosing a terminal portion of the second player section; and h. a second player goal mounted to the trampoline frame in the first player section adjacent to the first player middle trampoline;

i. a first player right enclosure panel extending from a right side of the first player right trampoline, wherein the first player right enclosure extends above the first player right trampoline;

j. a first player left enclosure panel extending from a left side of the first player left trampoline, wherein the first player left enclosure extends above the first player left trampoline;

k. a second player right enclosure panel extending from a right side of the second player right trampoline, wherein the second player right enclosure extends above the first player second trampoline; and l. a second player left enclosure panel extending from the left side of the second player left trampoline, wherein the second player left enclosure extends above the second player left trampoline.

2. The trampoline court of claim 1, wherein the trampoline frame comprises:

a. a first player terminal frame member extending across a terminal edge of the first player section, wherein the first player terminal frame member has a pair of first player terminal frame member upper portions connected by a first player terminal frame member top tension connector;

b. a partition frame member extending between the first player section and the second player section, wherein the partition frame member has a pair of upper portions connected by a first player terminal frame member top tension connector; and c. a second player terminal frame member extending across a terminal edge of the second player section wherein the second player terminal frame member has a pair of second player terminal frame member upper portions connected by a second player terminal frame member top tension connector.

3. The trampoline court of claim 2, wherein the trampoline frame comprises a plurality of trampoline legs supporting the trampoline frame.

4. The trampoline court of claim 3, further comprising: a first player right side goal mounted to the right of the first player goal and a first player left side goal mounted to the left of the first player goal; and a second player right side goal mounted to the right of the second player goal and a second player left side goal mounted to the left of the second player goal.

5. The trampoline court of claim 2, further comprising: a first player right side goal mounted to the right of the first player goal and a first player left side goal mounted to the left of the first player goal; and a second player right side goal mounted to the right of the second player goal and a second player left side goal mounted to the left of the second player goal.

6. The trampoline court of claim 1, wherein the first player right trampoline and the first player left trampoline have an angle between 25° and 35° relative to the first player middle trampoline; and wherein the second player right trampoline and the second player left trampoline have an angle between 25° and 35° relative to the second player middle trampoline.

7. The trampoline court of claim 1, further comprising: a first player right side goal mounted to the right of the first player goal and a first player left side goal mounted to the left of the first player goal; and a second player right side goal mounted to the right of the second player goal and a second player left side goal mounted to the left of the second player goal.

8. The trampoline court of claim 1, further comprising: a first player right side goal mounted to the right of the first player goal and a first player left side goal mounted to the left of the first player goal; and a second player right side goal mounted to the right of the second player goal and a second player left side goal mounted to the left of the second player goal.

9. The trampoline court of claim 1, wherein the trampoline frame comprises:

a. a first player terminal frame member extending across a terminal edge of the first player section, wherein the first player terminal frame member has a pair of first player terminal frame member upper portions connected by a first player terminal frame member top tension connector;

b. a partition frame member extending between the first player section and the second player section, wherein the partition frame member has a pair of upper portions connected by a first player terminal frame member top tension connector; and c. a second player terminal frame member extending across a terminal edge of the second player section wherein the second player terminal frame member has a pair of second player terminal frame member upper portions connected by a second player terminal frame member top tension connector.

10. The trampoline court of claim 1, wherein the trampoline frame comprises a plurality of trampoline legs supporting the trampoline frame.

11. The trampoline court of claim 1, wherein the trampoline frame comprises a plurality of trampoline legs supporting the trampoline frame.

* * * * *